United States Patent [19]

Stoddard et al.

[11] Patent Number: 4,946,032

[45] Date of Patent: Aug. 7, 1990

[54] DISPLAY COOLER

[75] Inventors: David C. F. Stoddard, Atlanta; Randall E. Bailey, Alpharetta, both of Ga.

[73] Assignee: The Mead Corporation, Dayton, Ohio

[21] Appl. No.: 366,695

[22] Filed: Jun. 14, 1989

[51] Int. Cl.[5] ..... B65D 5/52

[52] U.S. Cl. ..... 206/44 R; 206/44 K; 62/457.1; 62/372; 312/265.6; 312/236; 248/174; 220/84

[58] Field of Search ..... 206/44 R, 44.11, 44 K; 62/457.1, 246, 372; 312/236, 265.6; 248/129, 174; 220/83, 84

[56] References Cited

U.S. PATENT DOCUMENTS

| | | | |
|---|---|---|---|
| 431,865 | 7/1890 | Barker et al. | 62/372 |
| 2,786,339 | 3/1957 | Roberts | 62/457.1 |
| 3,228,736 | 1/1966 | Beckerman | 220/84 |
| 3,399,546 | 9/1966 | Kuns | 62/457.1 |
| 3,990,601 | 11/1966 | Joyce | 248/174 |
| 4,197,939 | 4/1980 | Dogliotti | 206/44 R |
| 4,420,097 | 12/1983 | Motsenbocker | 62/457.1 |
| 4,483,157 | 11/1984 | Human | 62/457.1 |
| 4,546,900 | 10/1985 | Lackey | 62/457.1 |
| 4,570,805 | 2/1986 | Smith | 248/174 |
| 4,582,195 | 4/1986 | Carten | 206/44 R |
| 4,638,645 | 1/1987 | Simila | 62/457.1 |
| 4,771,908 | 9/1988 | McIntosh | 220/84 |
| 4,813,536 | 3/1989 | Willis | 248/174 |

*Primary Examiner*—David T. Fidei
*Attorney, Agent, or Firm*—Rodgers & Rodgers

[57] ABSTRACT

A display cooler for cold drinks and the like includes support stand, a bin formed of insulating material and mounted atop the support stand together with an open ended enclosure including vertical panels arranged in cross sectional configuration which is complementary to that of the bin and which is disposed about the support stand and the bin and in snug relation therewith, a decorative design on the exterior surfaces of at least some of the walls of the cooler for use in enhancing the attractiveness thereof and if desired for use for brand name identification. The enclosure is secured to the support stand and a plurality of decorative brand name identifying panels may be arranged in overlying relation with the walls of the enclosure.

18 Claims, 3 Drawing Sheets

DISPLAY COOLER

TECHNICAL FIELD

This invention relates to coolers of the type used to display and to vend point of purchase items such as cold drinks and the like.

BACKGROUND ART

U.S. Pat. No. 4,546,900 issued Oct. 15, 1985 and owned by the assignee of this invention discloses and claims a container for displaying consumer items such as soft drinks and the like in ice. The display device according to this patent has the appearance of a half barrel and does not otherwise emphasize decorative aspects or brand name identification.

SUMMARY

According to this invention a display cooler is provided which is economical to manufacture and which emphasizes decorative features and may include brand name identification.

According to this invention in one form, a display cooler for cold drinks and the like is provided and includes a support stand, a bin formed of insulating material and mounted atop the support stand for containing ice and items such as cold drinks together with an open ended enclosure disposed about said support stand and said bin and in snug relation therewith, a decorative design on the exterior surfaces of at least some of the walls of the cooler and serving as brand name identification.

According to one modification of the invention the enclosure is secured to the support stand and a plurality of panels are arranged in overlying relation with corresponding side and front walls of said enclosure.

According to another modification of the invention the enclosing structure may simply comprise corrugated paperboard surrounding the support stand and bin together with decorative art work applied to at least some of the walls of the enclosing structure.

BEST MODE OF CARRYING OUT THE INVENTION

Figure 4:
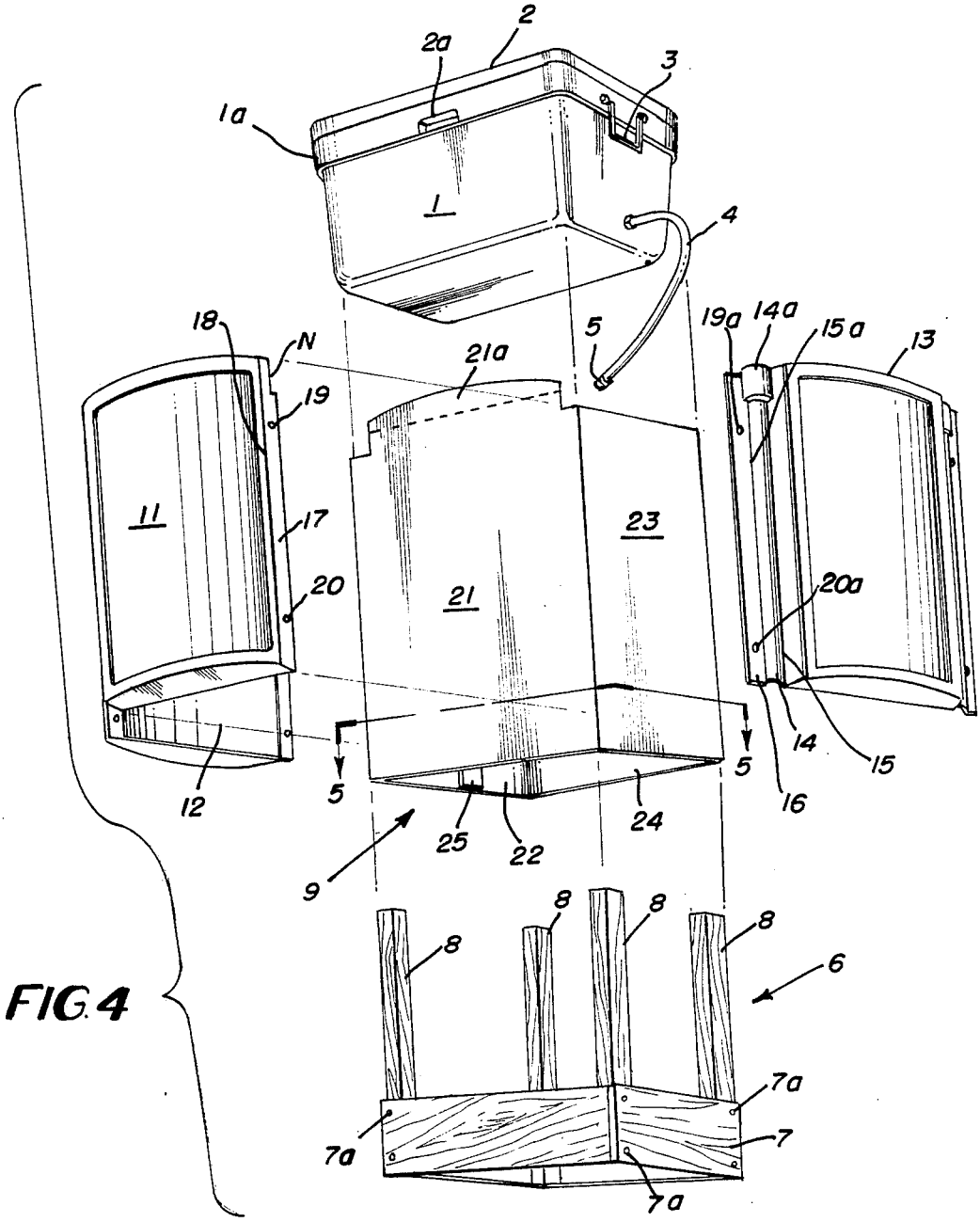
FIG. 4 is an exploded view of the structure shown in FIGS. 1, 2 and 3.

With reference to FIG. 4, a bin designated by the numeral 1 is formed of insulating material and includes a top 2 hingedly mounted by hinges H1 and H2 together with lifting handles 3 only one of which is observable in FIG. 4. A closable drain tube 4 is interconnected with the bin 1 and serves to drain away water resulting from the melting of ice in bin 1. Closure element 5 of known construction is formed at the end of drain tube 4.

Support stand generally designated by the numeral 6 comprises a four panel frame 7 within which four corner posts 8 are secured by suitable means such as by screws **7*a***.

Figure 1:
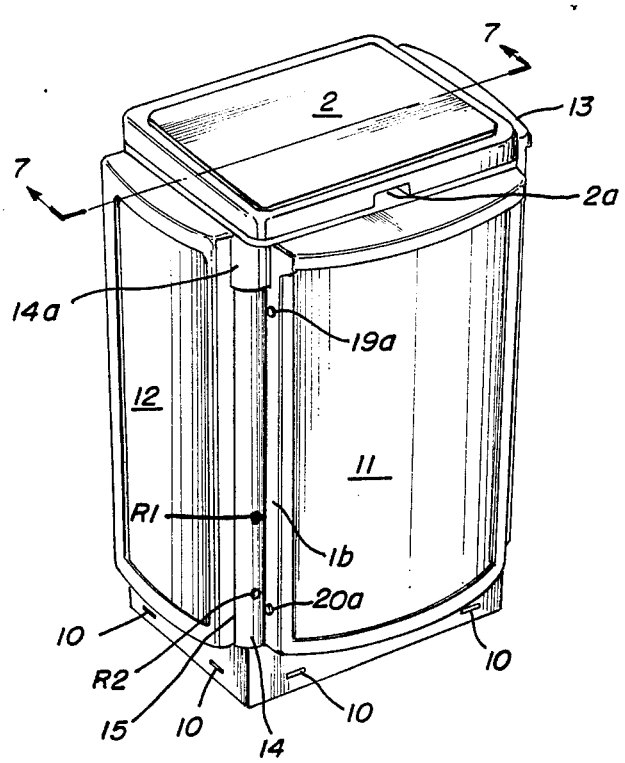
FIG. 1 is a perspective view of a display cooler formed according to this invention.
Figure 2:
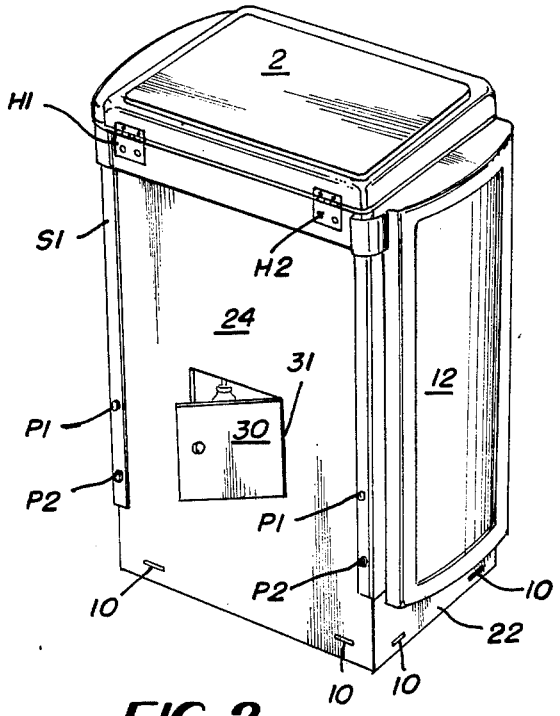
FIG. 2 is a view of the cooler shown in FIG. 1 as seen from a different vantage point.
Figure 3:
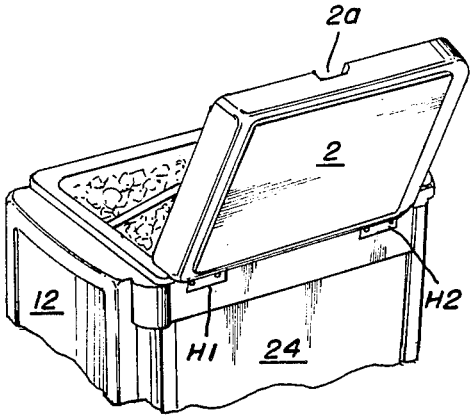
FIG. 3 is a view of the top portion of the cooler as shown in FIGS. 1 and 2 but with the top of the bin shown in open position.

When in assembled condition as shown in FIGS. 1, 2 and 3, the bin 1 is supported atop the support stand 6 and the open ended enclosing structure generally designated by the numeral 9 envelopes bin 1 and the support stand 6. The open ended enclosure 9 is secured to the four panels of frame 7 of the support stand 6 by securing means such as by staples designated by the numeral 10 in FIGS. 1 and 2.

For enhancing the appearance of the assembled display cooler, decorative covering means including front panel 11 and side panels 12 and 13 ar provided.

In order to secure adjacent edges of front panel 11 and side panel 13, and as best shown in FIG. 4, an arcuate projection 14 is integrally secured to an edge 15 of side panel 11 and a fastening strip 16 is integrally secured to edge **15*a* of arcuate projection 15. A fastening strip 17 is integrally secured to a side edge 18 of front panel 11. Fastening strips 16 and 17 are secured together in flat face contacting relation by suitable means such as rivets inserted into apertures 19 and 20 in strip 17 and into corresponding apertures 19*a* and 20*a* in strip 16. FIG. 1 shows arcuate projection 14 secured to front edge 15 of side panel 12 and fastening strip 16 secured to arcuate projection 14. The back panel S1 of panel 13 is secured to the enclosing structure by pins P1 and P2 which fasten strip S1 in place as shown in FIG. 2. Notch N of fastening strip 17 receives projection 14*a* of arcuate projection 14. Rivets R1 and R2 secure projection 14 to enclosure 9**.

Side panel 12 is secured in a manner identical to the manner in which side panel 13 is mounted.

Enclosing structure 9 comprises front panel 21, side panels 22 and 23 and rear panel 24. These panels are foldably adjoined at their corners and the side wall 22 includes a lap joint 25 as is well understood.

Figure 5A:
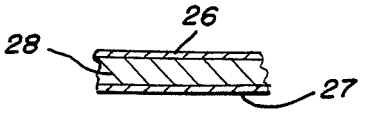
FIG. 5A is an enlarged fragmentary cross sectional view of the wall of the enclosure shown in FIG. 5.
Figure 5:
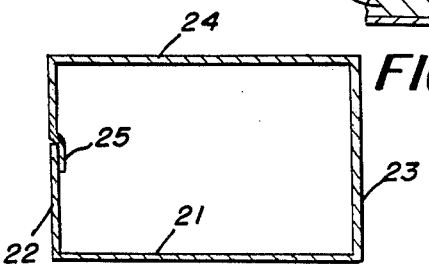
FIG. 5 is a cross sectional view of the enclosure taken along the line designated 5-5 in FIG. 4.

As is best shown in FIG. 5A the walls of the enclosing structure 9 comprise spaced outer panels 26 and 27 together with spaced transverse strips 28 which are secured along their edges to the inner surfaces of outer panels 26 and 27. The enclosing structure 9 may be formed of polyethylene or of poly-propylene.

The bin 1 includes an integral outer reinforcing rib **1*a*. This rib is received within the outwardly bulged upper portion 14*a* of arcuate projection 14** to afford a measure of stability and mechanical strength to the overall structure.

Figure 6:
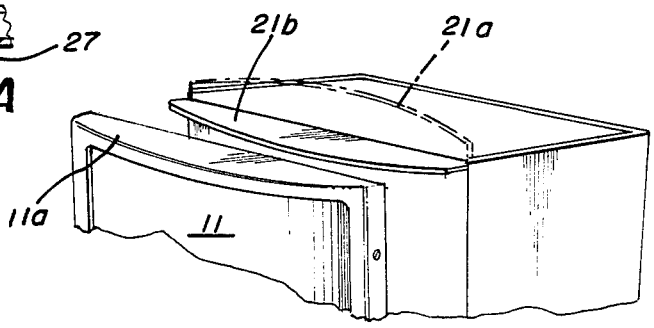
FIG. 6 is a perspective view of the top portion of the display cooler shown in FIGS. 1 and 2.
Figure 7:
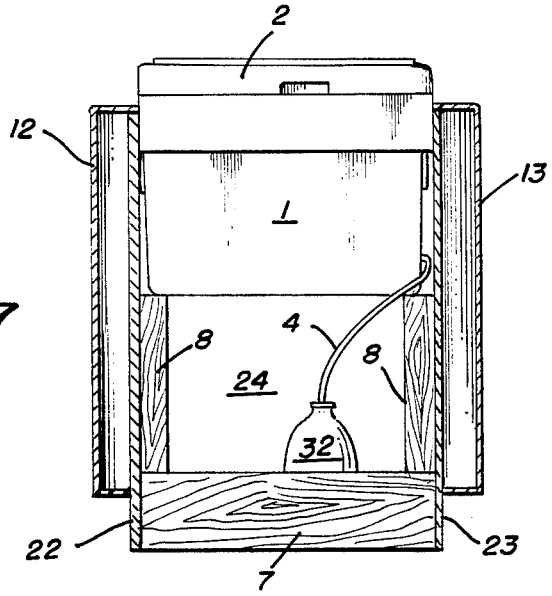
FIG. 7 is a cross sectional view taken along the line designated 7—7 in FIG. 1

As is best shown in FIGS. 4 and 6 the front panel 21 of the enclosing structure 9 includes an upwardly projecting arcuate extension designated **21*a* in phantom lines. This projection is folded over to occupy the position designated 21*b* in solid lines in FIG. 6. This projection underlies the top portion 11*a* of the front outer panel 11** when assembled.

As is shown in FIG. 2 an access door 30 is hingedly mounted at 31 to the back panel 24 of enclosing structure 9. This access panel renders the container 32 readily removable so that the water content thereof may be discharged as may be necessary.

For manipulating the cover 2 between open and closed positions, manually engageable recess **2*a* is provided as best shown in FIG. 1**. From the above description it is apparent that by the invention an economical and attractive display cooler has been provided which affords ample opportunity to exhibit name brand identification along with decorative features.

Figure 8:
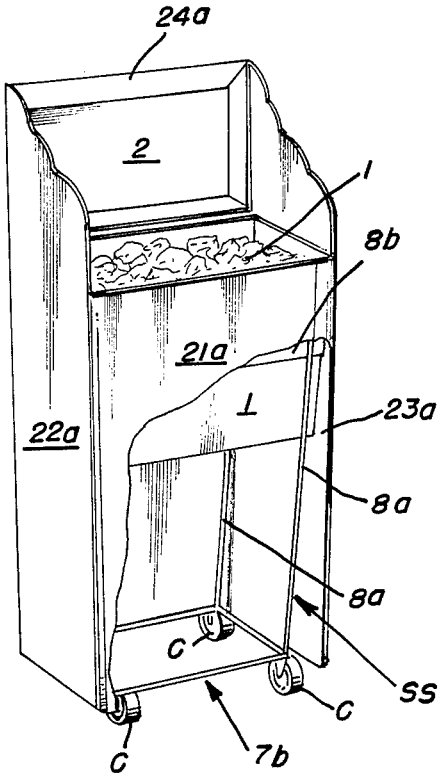
FIG. 8 is a perspective view of a modification of the invention shown in FIGS. 1–7 inclusive.

According to a modification of the invention as shown in FIG. 8, the bin 1 may be supported by a support stand SS which includes a horizontal frame structure 7*b* which is made up of four metal rods interconnected to form a rectangular structure together with corner posts 8*a* only two of which are observable in FIG. 8. Corner posts 8*a* are interconnected at their upper ends by a rectangular wire frame designated at 8*b*. As is obvious only a small fragment of the rectangular frame 8*b* is observable in FIG. 8.

The bin 1 and support stand SS are enclosed by front, side and rear walls formed of corrugated paperboard foldably adjoined along vertical edges to define four corners. In FIG. 8 the front panel of this enclosure is designated 21*a* and side panels 22*a* and 23*a* are foldably joined along their front edges to the side edges of front panel 21*a*. The back wall of the structure of FIG. 8 is designated at 24*a* the side edges of which are foldably joined to the rear edges of side walls 22*a* and 23*a*. A suitable lap joint is provided which preferably is at one vertical edge of back panel 24*a*.

If desired the support stand SS may be mounted on casters designated C only three of which are observable in FIG. 8.

One main advantage of the structure of FIG. 8 is the fact that it is economical and simple to manufacture and to assemble at a point of use.

We claim:

1. A display cooler for cold drinks and the like comprising a support stand, a bin formed of insulating material and mounted atop said support stand, said bin having side walls arranged in quadrilateral cross sectional configuration and having right angle corners, and an open ended enclosure of said cross sectional configuration which is complementary to that of said bin and being which is disposed about said support stand and said bin in snug relation therewith, means securing said enclosure to said support stand and forming a fixed structural relation therewith, and decorative covering means including a plurality of panels arranged in overlying relation with a plurality of corresponding walls of said enclosure respectively.

2. A display cooler according to claim 1 wherein said support stand comprises a four panel frame and four corner posts secured to the inside corners of said frame, and means securing said enclosure to said frame.

3. A display cooler according to claim 1 wherein said bin includes an outer reinforcing rib integral with said side walls and disposed about the upper parts thereof.

4. A display cooler according to claim 2 wherein said enclosure is formed of plastic material including a pair of spaced outer panels and inner structure including transverse spaced strips interposed between and secured to the inner surfaces of said outer panels.

5. A display cooler according to claim 4 wherein said transverse spaced strips of said inner structure are disposed to impart a measure of stability to said enclosure.

6. A display cooler according to claim 4 wherein said enclosure is formed of polyethylene.

7. A display cooler according to claim 4 wherein said enclosure is formed of poly-propylene.

8. A display cooler according to claim 1 wherein said plurality of panels are secured to said enclosure.

9. A display cooler according to claim 1 wherein adjacent edges of said plurality of panels include fastening strips secured to each other in flat face contacting relation.

10. A display cooler according to claim 1 wherein the rear edges of the side ones of said plurality of panels are secured to said enclosure by apertured fastening strips and associated rivets.

11. A display cooler according to claim 1 wherein said decorative covering means includes a front panel of outwardly bowed configuration adjoined along its side edges respectively with a front edge of a pair of side outwardly bowed panels.

12. A display cooler according to claim 11 wherein a corner defined by the junction of the side edges of a side and front panel includes an arcuate projection along the side edge of one of said panels.

13. A display cooler according to claim 12 wherein a first fastening strip is integrally formed along an edge of said arcuate projection which is remote from its associated panel.

14. A display cooler according to claim 13 wherein a complementary fastening strip is integrally formed along a side edge of the other of said panels and secured in flat face contacting relation with said first fastening strip.

15. A display cooler according to claim 1 wherein a closable outlet drain is connected to said bin.

16. A display cooler according to claim 15 wherein a removable receptacle is disposed underneath said bin and in communication with said outlet drain, and an access door is formed in said enclosure.

17. A display cooler according to claim 3 wherein an arcuate projection is formed along the front edge of each of said side panels and wherein an enlarged upper part of each of said arcuate projections is constructed to encompass said outer reinforcing rib of said bin.

18. A display cooler according to claim 17 wherein a fastening strip is formed along each side edge of the front decorative panel and wherein a notch is formed in the upper part of each of said fastening strips to receive the adjacent enlarged upper part of each of said arcuate projections.

* * * * *